US005165818A

United States Patent [19]

Newhart

[11] Patent Number: 5,165,818

[45] Date of Patent: Nov. 24, 1992

[54] TRAFFIC DIRECTING SIGN

[75] Inventor: William A. Newhart, Camp Hill, Pa.

[73] Assignee: RRETEX, Inc., Mechanicsburg, Pa.

[21] Appl. No.: 664,748

[22] Filed: Mar. 5, 1991

[51] Int. Cl.[5] ..... E01F 9/00; E01F 15/00

[52] U.S. Cl. ..... 404/10; 256/13.1

[58] Field of Search ..... 404/9, 10; 256/1, 13.1; 116/63, 63 P; 40/612, 607, 606, 602, 584

[56] References Cited

U.S. PATENT DOCUMENTS

| | | | |
|---|---|---|---|
| 3,308,584 | 3/1967 | Graham | 52/90 |
| 3,732,842 | 5/1973 | Vara, Sr. | 116/63 P |
| 3,851,615 | 12/1974 | Grundvig et al. | 116/63 R |
| 4,071,970 | 2/1978 | Strizki | 40/607 |
| 4,171,919 | 10/1979 | Willis | 403/11 |
| 4,245,922 | 1/1981 | Auriemma | 256/1 |
| 4,298,292 | 11/1981 | Sweeney | 256/13.1 |
| 4,435,107 | 3/1984 | Sweeney | 256/13.1 |
| 4,462,711 | 7/1984 | Garner | 404/10 |
| 4,557,449 | 12/1985 | Davidson et al. | 248/160 |
| 4,645,168 | 2/1987 | Beard | 404/10 |
| 4,783,921 | 11/1988 | George | 40/602 |
| 4,792,258 | 12/1988 | Goff | 404/6 |
| 4,798,017 | 1/1989 | Giotis | 40/612 |
| 4,806,046 | 2/1989 | Clark | 404/10 |
| 4,928,446 | 5/1990 | Alexander | 404/10 |
| 4,958,954 | 9/1990 | Schmanski et al. | 256/1 |
| 5,004,366 | 4/1991 | Simmons | 404/10 |
| 5,060,437 | 10/1991 | Parsons | 404/10 |

FOREIGN PATENT DOCUMENTS

| | | | |
|---|---|---|---|
| 213114 | 3/1987 | European Pat. Off. | 404/10 |
| 1255128 | 11/1967 | Fed. Rep. of Germany | 404/10 |
| 2218869 | 10/1973 | Fed. Rep. of Germany | 404/10 |
| 3412999 | 7/1985 | Fed. Rep. of Germany | 404/10 |
| 3540772 | 5/1987 | Fed. Rep. of Germany | 404/10 |
| 3718440 | 12/1988 | Fed. Rep. of Germany | 404/10 |

*Primary Examiner*—Ramon S. Britts
*Assistant Examiner*—Nancy P. Connolly
*Attorney, Agent, or Firm*—Foley & Lardner

[57] ABSTRACT

A free-standing traffic directing sign consisting of a base, a panel which fits into a slot in the base, and a breakway mounting assembly including a pin. The breakaway mounting assembly is connected to the base and is designed to retain the panel in the slot. When a predetermined force, such as a vehicle striking the sign, is applied to the panel and transmitted to the mounting assembly, the pin of the mounting assembly breaks allowing the panel to pop out of the slot. A new pin can be used to reassemble the panel and the base.

13 Claims, 2 Drawing Sheets

TRAFFIC DIRECTING SIGN

BACKGROUND OF THE INVENTION

1. Field of the Invention

This invention relates to vehicular traffic signs, and more particularly to vehicular traffic signs having upstanding panels that are releasably mounted in a base.

2. Brief Description of the Prior Art

Traffic signs are used for many different purposes, including providing printed information to motorists or simply for redirecting the flow of traffic. Typically, these signs consist of a base portion which is connected to an upstanding post and an information/directing panel attached to the post. These signs can be permanently mounted at one location or are designed to be free-standing portable signs which can be used to direct traffic at one particular site and subsequently moved and used at another site. These portable signs are often used to direct traffic at sites where road construction is taking place. It is very important, therefore, that the free-standing signs be capable of withstanding severe wind conditions so that they are not easily moved or blown over which would prevent the motorist from seeing the panel. In many cases, to prevent the movement of these signs, sandbags have been employed around the base of the traffic sign to provide stability.

One disadvantage of typical signs is that they are often made of metal which when exposed to the environment over long periods of time can cause the sign to rust and eventually break. Additionally, vehicles frequently hit these signs, resulting in damage to both the vehicle and the sign as the vehicle passes over the sign. Metal signs, in particular, are subject to severe damage since they are not very pliable and are easily deformed as the vehicle tire passes over them. Most signs also require various hand tools to put them together or to fix them after they are damaged, which makes initial assembly, installation and repairs both time-consuming and costly.

Various sign assemblies have been designed to overcome some of the disadvantages discussed above. One type of sign has a breakaway portion so that when the vehicle strikes the sign, one portion of the sign breaks away from a second base portion. This minimizes the damage to the vehicle since the vehicle does not run over a high-profile projection. A known sign of this type is described in U.S. Pat. No. 4,798,017. In this patent, a flexible but resilient panel is supported on a post. The post is detachably connected to a stabilizing base via a clamping device. In operation, when a vehicle strikes the sign assembly, the post breaks away from the base assembly and lies flat on the ground. The problem with this design is that part of the post is destroyed, and remounting the post requires turning the sign upside down. However, after a second occurrence, the post would have to be replaced. Additionally, when the post and panel assembly are lying on the ground, the tire of the vehicle may run over it. Since the post may lie between the ground and the panel, severe damage to the panel can still occur as the vehicle passes over and bends the panel. Furthermore, due to the supporting post structure, only one side of the panel is usable as a traffic directing device since the post would block the opposite surface on the back side of the panel.

In U.S. Pat. No. 3,308,584 there is disclosed a breakaway highway guidepost. In this patent, the guidepost consists of a first post member which is anchored in the ground and has a ball-type surface extending above the ground, and a second post member (which extends above ground) and which has a socket at one end which is designed to receive the ball of the first post member creating a ball and socket arrangement. The ball and socket are secured together by blind rivets and a traffic directing panel is mounted to the second post member. Therefore, when a vehicle strikes the guidepost, the rivets break and the second post member rotates on the ball of the first post member until it strikes the ground. The disadvantages of this patent are that first of all it is not portable; secondly, when lying on the ground, the panel is still subject to damage by the vehicle tire; and thirdly, a rivet gun is required to insert the rivets into the guidepost during initial assembly or for field repairs.

Thus, in the current art of traffic directing signs, while breakaway signs are known, they are generally either not portable and/or are attached to a post which exposes the panel to potential damage if a vehicle tire were to pass over it. What the current art of traffic directing signs lacks is a portable free-standing sign which has a traffic directing panel that is releasably mounted in a base without requiring the use of a post to support the panel. Therefore, when the panel is struck by a vehicle, it will lie flat on the ground and will not be subjected to damage as the vehicle tire passes over it. The current art of traffic directing signs further lacks a non-metallic sign which does not corrode and which is resilient and pliable so that neither the base nor the panel is subject to deformation as the vehicle tire passes over.

SUMMARY OF THE INVENTION

It is an object of the invention to provide a portable free-standing traffic sign that has a traffic direction panel releasably mounted in a base assembly so that when the panel is released by the impact of a vehicle, the panel will lie flat on the ground and not be subject to damage as the tire passes over it.

It is yet another objective of the invention to provide a base assembly which will remain in place after the panel breaks away.

Another object of the invention is to provide a panel mounted to the base assembly which can withstand all wind conditions, thereby allowing the face of the panel to always be visible to oncoming traffic.

In yet another objective of the invention, the base assembly is preferably made from a resilient material such that the base assembly is not damaged when the vehicle passes over it.

Another object of the invention is to provide a base assembly capable of receiving a panel, such that the panel is fully supported on the base assembly without requiring any mounting device such as a post.

Yet another object of the invention is to provide a traffic directing sign which can be easily assembled, repaired and disassembled without the use of any hand tools.

Still another object of the invention is to provide a traffic directing sign which, upon disassembly, has a stackable base and panel for use during transportation and storage.

Another object of the invention is to provide a traffic sign that has a panel with slip-on edge moldings to protect the reflective surface of the panel during transportation, storage, or when it strikes the ground consequent to the impact of a vehicle.

Another object of the invention is to provide a traffic sign that has a base designed to receive a standard road light, and a panel which is capable of supporting a road light lens mounted on the panel.

Finally, another object of the invention is to provide a traffic sign that it is easily placed on or picked up from the road surface.

BRIEF DESCRIPTION OF THE DRAWINGS

Other objects, features and advantages of the present invention will become apparent from the following detailed description and accompanying drawings wherein.

DETAILED DESCRIPTION OF THE PREFERRED EMBODIMENTS

Figure 1:
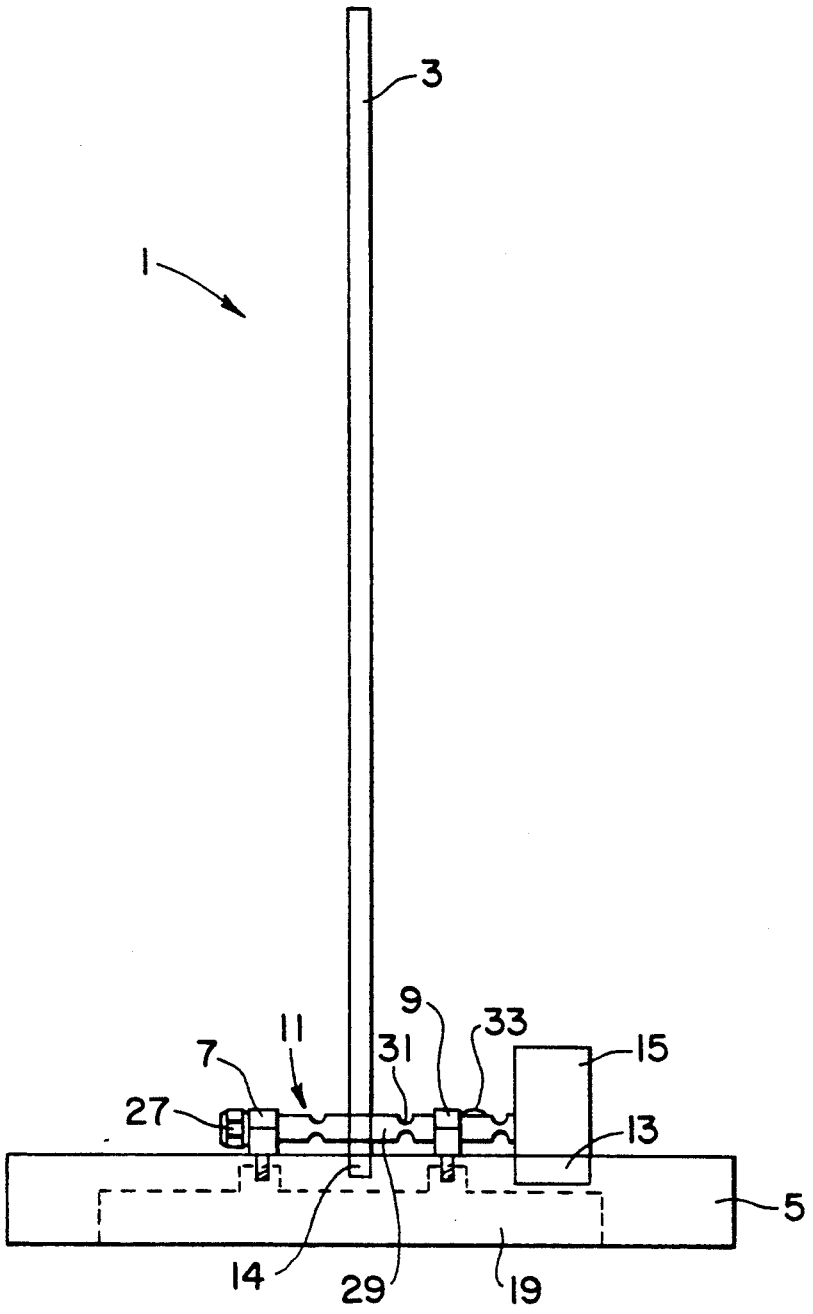
FIG. 1 is a side view of a traffic directing sign.

FIG. 1 illustrates a traffic directing sign generally indicated at 1 comprised of a panel member 3, a base 5, retaining blocks 7, 9 and breakaway pin 11.

Figure 2:
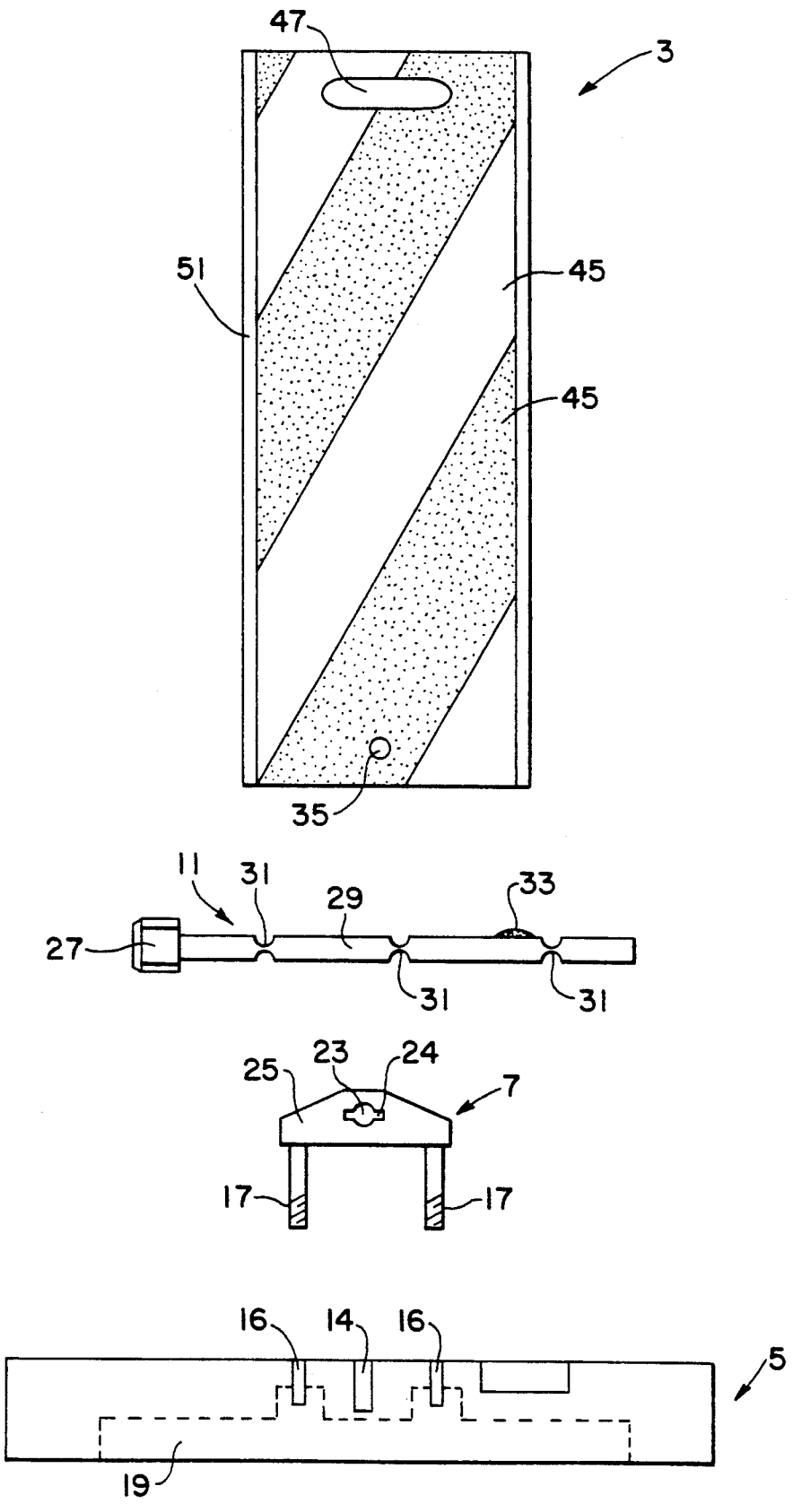
FIG. 2 is an exploded view of the traffic directing sign of FIG. 1 with the panel and retaining block shown in front view and the pin and base shown in side view.

Referring to FIGS. 1 and 2, base 5 has a pocket 13. designed to receive a standard road light 15. In addition, base 5 has a slot 14 which can be either straight or elliptical and into which panel member 3 fits. The slot 14 and base 5 are designed such that when the panel member 3 is in the slot 14, the base 5 is capable of fully supporting the upstanding panel member 3. Additionally, four holes 16 (only two of which are shown) are provided in base 5 and are designed to receive the threaded portions 17 of retaining blocks 7, 9 so that the threaded portions project through the base 5 and can be secured in place by a nut (not shown).

Base 5 is formed with a recessed bottom portion 19, which not only permits the threaded portion 17 to be received and secured, but also allows the base 5 to obtain maximum pounds per square inch along the bottom outside perimeter of the base which provides for a very stable base design.

Since a key objective of the invention is to provide a portable and free-standing traffic sign, the base must be of sufficient weight and design to preclude being blown over. Additionally, the base should remain in place when the traffic sign is struck by an automobile and should be resilient enough to withstand a vehicle tire passing over it without being damaged. Accordingly, in the preferred embodiment, the base 5 is molded from recycled rubber commonly referred to as "crum rubber." This rubber provides sufficient weight to keep the base in place and is also very resilient. However, the base could also be made of other suitable material which provides stability and resiliency similar to the crum rubber molded base.

Base 5 also is provided with drain holes (not shown) in the bottom of slot 14 and pocket 13 and communicating with the recessed bottom 19, to insure that water does not build up in the slot 14 or pocket 13.

Retaining blocks 7, 9 are preferably made of plastic but could also be made of any other metallic or non-metallic materials. In addition, in another embodiment the retaining blocks 7, 9 can be molded as an integral part of base 5. Referring to FIG. 2, retaining block 7 has a keyway 23 running completely through the upper member 25 of the block. Keyway 23 is formed with radial extensions 24 to permit the breakaway pin 11 to be inserted through the keyway, as will be hereinafter described.

Breakaway pin 11 has a knob 27 at one end and a shaft portion 29 formed with reduced diameter sections 31 and a projection 33. The reduced diameter sections 31 are designed to break when subjected to a predetermined force while the projection 33 is designed to fit through keyway 23 whereupon the breakaway pin 11 can be rotated thereby locking itself in place.

As shown in FIG. 1, the panel 3 is mounted on the base by inserting pin 11 through retaining block 7, a hole 35 in panel member 3, retaining block 9, and into a shallow mounting hole or recess (not shown) in standard light 15. The orientation of the pin during inserting is such that the projection 3 is aligned with the radially elongated part of the keyway 23. When fully inserted, the pin is then rotated to disalign the projection 33 from one or the other of the extensions 24 so as to preclude unintentional withdrawal of the pin. It will thus be seen that the pin 11 secures both the panel 3 in slot 14 and the light 15 in pocket 13.

In operation, several of the signs are normally positioned in sequence to divert or direct traffic in a predetermined pattern. If an oncoming vehicle strikes panel member 3, a corresponding force will be exerted on breakaway pin shearing the reduced diameter sections 31 and allowing the panel member 3 to pop out of the slot 14 and fall onto the ground without disrupting the position of base 5. Thus, as the vehicle passes over either base 5 or panel member 3 no damage will occur to these items because they are laying flat on the ground. Furthermore, no damage will occur to the vehicle since neither the panel 3 nor base 5 has a high enough profile to damage the underside of the vehicle.

Reassembly of the traffic sign is then simply accomplished without the use of tools by inserting the panel 3 back into the slot 14 and sliding a new breakaway pin 11 in place.

In the preferred embodiment, the breakaway pin 11 and panel member 3 are made from plastic. However, other similar materials which are metallic or non-metallic can be used such as, for example, a wooden or metal breakaway pin. Additionally, FIG. 2 shows that the panel 3 has a reflective surface (or surfaces) 45 for better visibility, and a hand slot 47 which allows for easy handling of the panel and the entire traffic sign. Since neither surface of the sign panel is obstructed by a post, both surfaces can contain reflective material. This provides great flexibility in using the sign 1 for different purposes by simply turning the panel 3 around in the slot 14.

Side moldings 51 can be provided to protect the reflective panel surface 45 when the panel is disconnected during impact as described, or during the transportation or storage modes of the sign.

While several embodiments of the invention have been described, it will be understood that further modifications can be made. This application is intended to cover any variations, use or adaptation of the invention and including such departures from the present disclosure as come within the knowledge of customary practice in the art to which the invention pertains, and as may be applied to the essential features hereinbefore set forth and following within the scope of the invention and the limits of the appended claims.

What is claimed is:

1. A traffic directing sign comprising:

a) a base having a slot disposed therein;

b) a panel which fits into said slot; and c) a breakaway mounting assembly which retains said panel in said slot, wherein said breakaway mounting assembly comprises first and second retaining blocks connected to said base, first and second keyways disposed within said first and second retaining blocks, respectively, and a breakaway pin which passes through said keyways and through an opening formed in said panel;

wherein when a predetermined force is applied to said panel, said breakaway mounting assembly breaks allowing said panel to pop out of said slot.

2. A traffic directing sign as claimed in claim 1, wherein said base is formed from molded crum rubber.

3. A traffic directing sign as claimed in claim 1, wherein said pin has a shaft portion, and a knob connected to said shaft portion, and wherein said shaft portion has at least one reduced diameter portion and a projection formed on the outer surface of said shaft portion.

4. A traffic directing sign as claimed in claim 1, wherein said base has a pocket, a road light received in said pocket, said light being formed with an opening or recess in the surface thereof facing said panel, and wherein said pin projects into said recess in said road light.

5. A traffic directing sign as claimed in claim 4, wherein said pocket and said slot have drain holes.

6. A traffic directing sign as claimed in claim 1, wherein said base has a recessed bottom.

7. A traffic directing sign as claimed in claim 6, wherein said base is formed from molded crum rubber.

8. A traffic directing sign as claimed in claim 7, wherein said retaining blocks are molded as part of said base.

9. A traffic directing sign as claimed in claim 1, wherein each of said retaining blocks has a pair of threaded prongs which project through said base for threaded engagement by retaining nuts.

10. A traffic directing sign as claimed in claim 1, wherein said retaining blocks, said pin, said panel and said base are all made of non-metallic material.

11. A traffic directing sign as claimed in claim 1, wherein front and back surfaces of said panel have reflective surfaces, and further comprising a pair of slip-on edge moldings which slidably engage opposite sides of said panel.

12. A traffic directing sign as claimed in claim 11, wherein said panel has a hand slot disposed therein adjacent the top thereof to facilitate handling of the sign.

13. A traffic directing sign comprising:

a) a base having a slot disposed therein;

b) a panel which fits into said slot;

c) a breakaway mounting assembly which retains said panel in said slot, so that when a predetermined force is applied to said panel, said breakaway mounting assembly breaks allowing said panel to pop out of said slot;

said breakaway mounting assembly comprising first and second retaining blocks connected to said base, first and second keyways formed in said first and second retaining blocks, and a breakaway pin which passes through said keyways and said panel;

said pin having a shaft portion and a knob connected to said shaft portion, said shaft portion having at least one reduced diameter portion and a projection on its outer surface;

said base having a pocket for receiving a road light formed with a recess, said pin projecting into said road light recess;

said base being formed from molded crum rubber;

each of said retaining blocks having a pair of threaded prongs which project through said base for securing to retaining nuts; and wherein said retaining blocks, said pin, said panel and said base are all made of non-metallic material.

* * * * *